US011604022B2

(12) United States Patent
Zha

(10) Patent No.: US 11,604,022 B2
(45) **Date of Patent: *Mar. 14, 2023**

(54) COOLING SYSTEM WITH COMPRESSOR BYPASS

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/471,422

(22) Filed: Sep. 10, 2021

(65) Prior Publication Data

US 2021/0404721 A1 Dec. 30, 2021

Related U.S. Application Data

(63) Continuation of application No. 16/716,686, filed on Dec. 17, 2019, now Pat. No. 11,150,001.

(51) Int. Cl.
*F25B 49/02* (2006.01)
*F25B 41/22* (2021.01)
(Continued)

(52) U.S. Cl.
CPC ..... *F25B 49/025* (2013.01); *F24F 11/46* (2018.01); *F25B 1/10* (2013.01); *F25B 41/22* (2021.01);
(Continued)

(58) Field of Classification Search
CPC ..... F25B 1/10; F25B 41/22; F25B 49/025; F25B 2400/0401; F25B 2500/31;
(Continued)

(56) References Cited

U.S. PATENT DOCUMENTS

2013/0098085 A1 4/2013 Judge et al.
2017/0074567 A1 3/2017 Ali et al.
(Continued)

FOREIGN PATENT DOCUMENTS

CN 109237844 A 1/2019
EP 2487437 A1 8/2012
JP 2003336929 A 11/2003

OTHER PUBLICATIONS

European Patent Office, Extended European Search Report, Application No. 20211688.5, dated Apr. 30, 2021, 11 pages.
(Continued)

*Primary Examiner* — Jonathan Bradford
(74) *Attorney, Agent, or Firm* — Baker Botts L.L.P.

(57) ABSTRACT

A cooling system is designed to generally allow for one or more compressors to be bypassed when ambient temperatures are low. The system includes a bypass line and valve that opens when ambient temperatures are low and/or when the pressure of the refrigerant in the system is low. In this manner, the refrigerant can flow through the bypass line instead of through one or more compressors. These compressors may then be shut off. To supply any needed pressure to cycle the refrigerant, the system may include a pump that turns on when the bypass line is open. When ambient temperatures are extremely low, thermosiphon may be used to cycle the refrigerant.

17 Claims, 4 Drawing Sheets

(51) Int. Cl.

| | |
|---|---|
| ***F24F 11/46*** | (2018.01) |
| ***F25B 1/10*** | (2006.01) |
| *F24F 110/12* | (2018.01) |
| *F25B 9/00* | (2006.01) |

(52) U.S. Cl.
CPC ..... *F24F 2110/12* (2018.01); *F25B 9/008* (2013.01); *F25B 2400/0401* (2013.01); *F25B 2400/077* (2013.01); *F25B 2500/31* (2013.01); *F25B 2600/02* (2013.01); *F25B 2600/2501* (2013.01); *F25B 2600/2519* (2013.01); *F25B 2700/2106* (2013.01); *F25B 2700/21151* (2013.01)

(58) Field of Classification Search
CPC ..... F25B 2600/2501; F25B 2600/2519; F25B 2700/2106; F25B 2700/21151; F24F 11/46; F24F 2110/12
See application file for complete search history.

(56) References Cited

U.S. PATENT DOCUMENTS

| | | | |
|---|---|---|---|
| 2017/0205120 | A1 | 7/2017 | Ali et al. |
| 2020/0116396 | A1 | 4/2020 | Ito et al. |
| 2021/0180846 | A1 | 6/2021 | Zha |

OTHER PUBLICATIONS

Carnot Refrigeration, "Rain Cycle Free-Cooling Process" www.carnotrefrigeration.com, Quebec, Canada, downloaded Dec. 17, 2019, 6 pages.

COOLING SYSTEM WITH COMPRESSOR BYPASS

CROSS-REFERENCE TO RELATED APPLICATIONS

This application is a continuation of U.S. patent application Ser. No. 16/716,686 filed Dec. 17, 2019, by Shitong Zha, and entitled "COOLING SYSTEM WITH COMPRESSOR BYPASS," which is incorporated herein by reference.

TECHNICAL FIELD

This disclosure relates generally to a cooling system.

BACKGROUND

Cooling systems may cycle a refrigerant (e.g., carbon dioxide refrigerant) to cool various spaces. These systems include compressors that compress the refrigerant.

SUMMARY

Cooling systems may cycle a refrigerant (e.g., carbon dioxide refrigerant) to cool various spaces. These systems include compressors that compress the refrigerant. When ambient temperatures (e.g., outdoor temperatures, temperatures around a high side heat exchanger, and temperatures around compressors and/or refrigerant tanks) are too cold, the pressure of the refrigerant in the system may drop too low for the compressors to operate effectively. To remedy this drop in pressure, conventional systems may reduce the speed of or turn off the high side heat exchanger (e.g., condenser or gas cooler). In instances where not much cooling is needed (e.g., because ambient temperatures are low), the compressor may also cycle on and off frequently, wasting energy.

This disclosure contemplates an unconventional cooling system that generally bypasses one or more compressors when ambient temperatures are low. The system includes a bypass line and valve that opens when ambient temperatures are low and/or when the pressure of the refrigerant in the system is low. In this manner, the refrigerant can flow through the bypass line instead of through one or more compressors. These compressors may then be shut off. To supply any needed pressure to cycle the refrigerant, the system may include a pump that turns on when the bypass line is open. When ambient temperatures are extremely low, thermosiphon may be used to cycle the refrigerant rather than a pump. Certain embodiments of the cooling system are described below.

According to an embodiment, a system includes a high side heat exchanger, a flash tank, a first low side heat exchanger, a second low side heat exchanger, a first compressor, a second compressor, a first valve, and a pump. The high side heat exchanger removes heat from a refrigerant. The flash tank stores refrigerant. The first low side heat exchanger uses refrigerant from the flash tank to cool a space proximate the first low side heat exchanger. The second low side heat exchanger uses refrigerant from the flash tank to cool a space proximate the second low side heat exchanger. The first compressor compresses refrigerant from the first low side heat exchanger. During a first mode of operation, the first valve is closed, the pump is off, and the second compressor compresses refrigerant from the second low side heat exchanger and refrigerant from the first compressor. During a second mode of operation, the first valve is open, the second compressor is off, and the pump pumps refrigerant from the flash tank to the first and second low side heat exchangers.

According to another embodiment, a method includes removing, by a high side heat exchanger, heat from a refrigerant and storing, by a flash tank, refrigerant. The method also includes using, by a first low side heat exchanger, refrigerant from the flash tank to cool a space proximate the first low side heat exchanger, using, by a second low side heat exchanger, refrigerant from the flash tank to cool a space proximate the second low side heat exchanger, and compressing, by a first compressor, refrigerant from the first low side heat exchanger. The method further includes during a first mode of operation, compressing, by a second compressor, refrigerant from the second low side heat exchanger and refrigerant from the first compressor while a first valve is closed and a pump is off and during a second mode of operation, pumping, by the pump, refrigerant from the flash tank to the first and second low side heat exchangers while the first valve is open and the second compressor is off.

According to yet another embodiment, a system includes a high side heat exchanger, a flash tank, a first low side heat exchanger, a second low side heat exchanger, a first compressor, a second compressor, and a first valve. The high side heat exchanger removes heat from a refrigerant. The flash tank stores refrigerant. The first low side heat exchanger uses refrigerant from the flash tank to cool a space proximate the first low side heat exchanger. The second low side heat exchanger uses refrigerant from the flash tank to cool a space proximate the second low side heat exchanger. The first compressor compresses refrigerant from the first low side heat exchanger. During a first mode of operation, the first valve is closed and the second compressor compresses refrigerant from the second low side heat exchanger and refrigerant from the first compressor. During a second mode of operation, the first valve is open, the second compressor is off, and refrigerant from the flash tank flows through the first and second low side heat exchangers to high side heat exchanger by thermosiphon.

Certain embodiments provide one or more technical advantages. For example, an embodiment allows for one or more compressors to be shut off and bypassed when ambient temperatures are low. As another example, an embodiment reduces the waste caused by turning a compressor and off when system pressure is low. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 4 of the drawings, like numerals being used for like and corresponding parts of the various drawings.

Cooling systems may cycle a refrigerant (e.g., carbon dioxide refrigerant) to cool various spaces. These systems include compressors that compress the refrigerant. When ambient temperatures (e.g., outdoor temperatures, temperatures around a high side heat exchanger, and temperatures around compressors and/or refrigerant tanks) are too cold, the pressure of the refrigerant in the system may drop too low for the compressors to operate effectively. To remedy this drop in pressure, conventional systems may reduce the speed of or turn off the high side heat exchanger (e.g., condenser or gas cooler). In instances where not much cooling is needed (e.g., because ambient temperatures are low), the compressor may also cycle on and off frequently, wasting energy.

Figure 1:
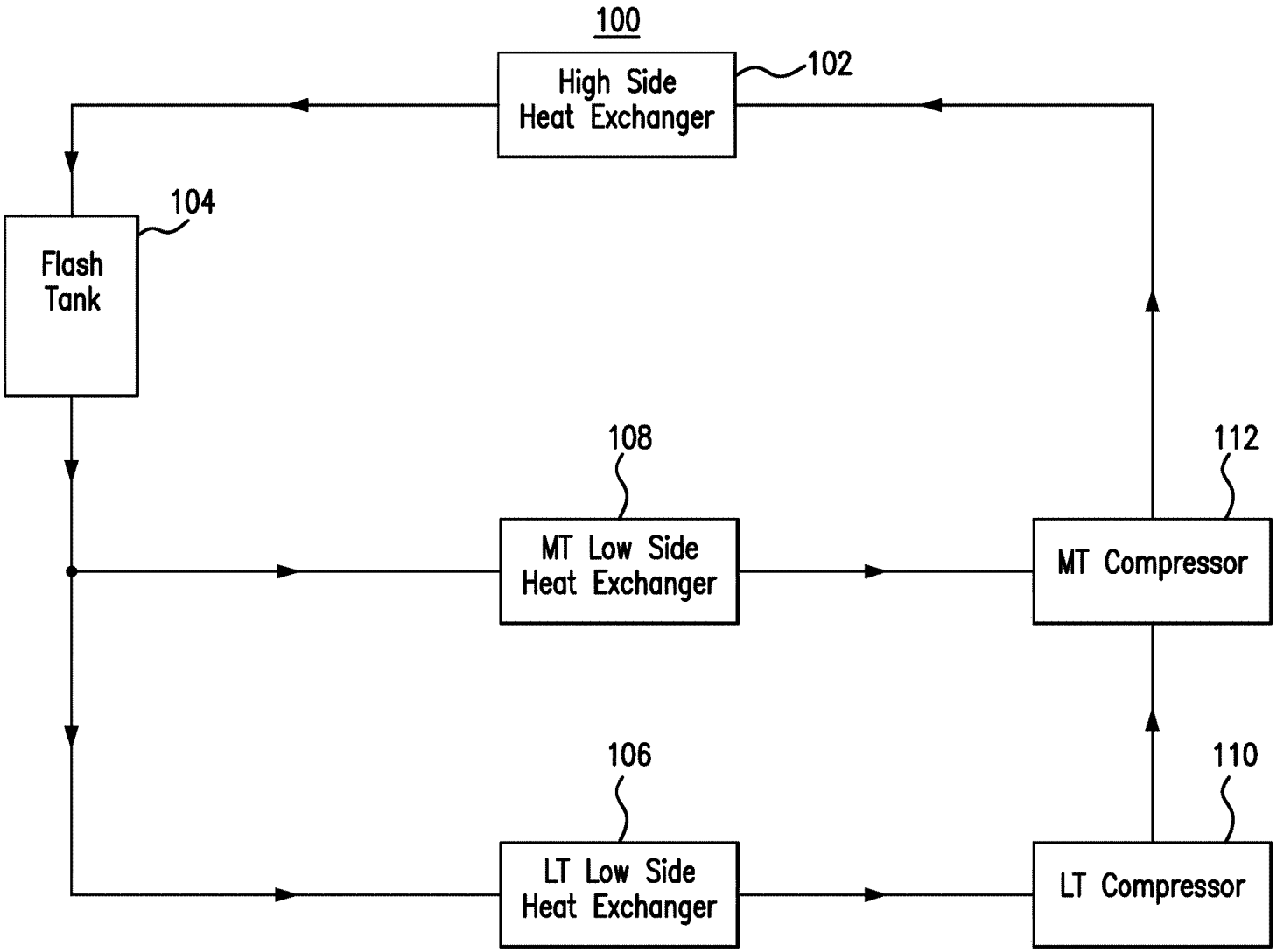
FIG. 1 illustrates an example cooling system.
Figure 2:
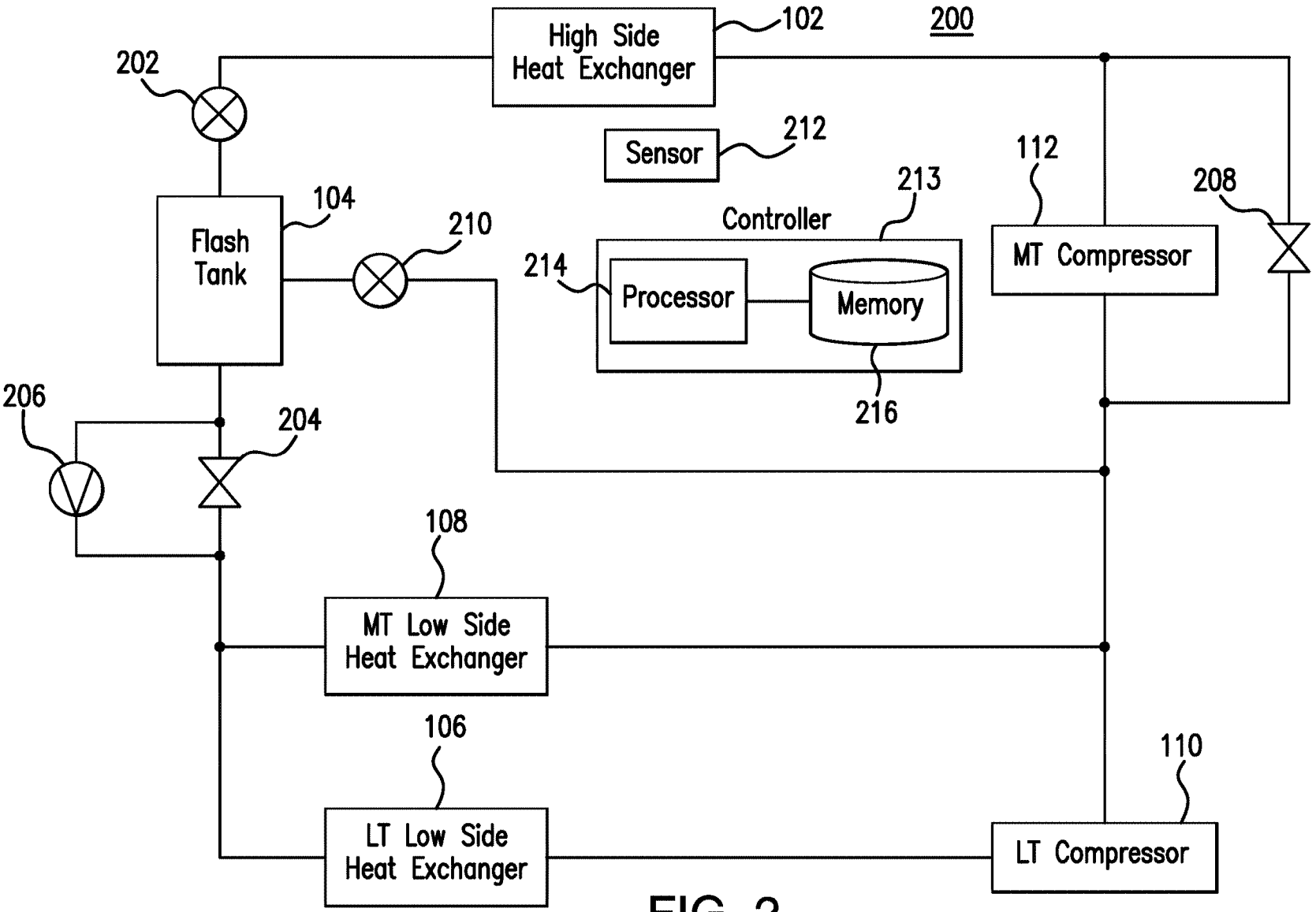
FIG. 2 illustrates an example cooling system.
Figure 3:
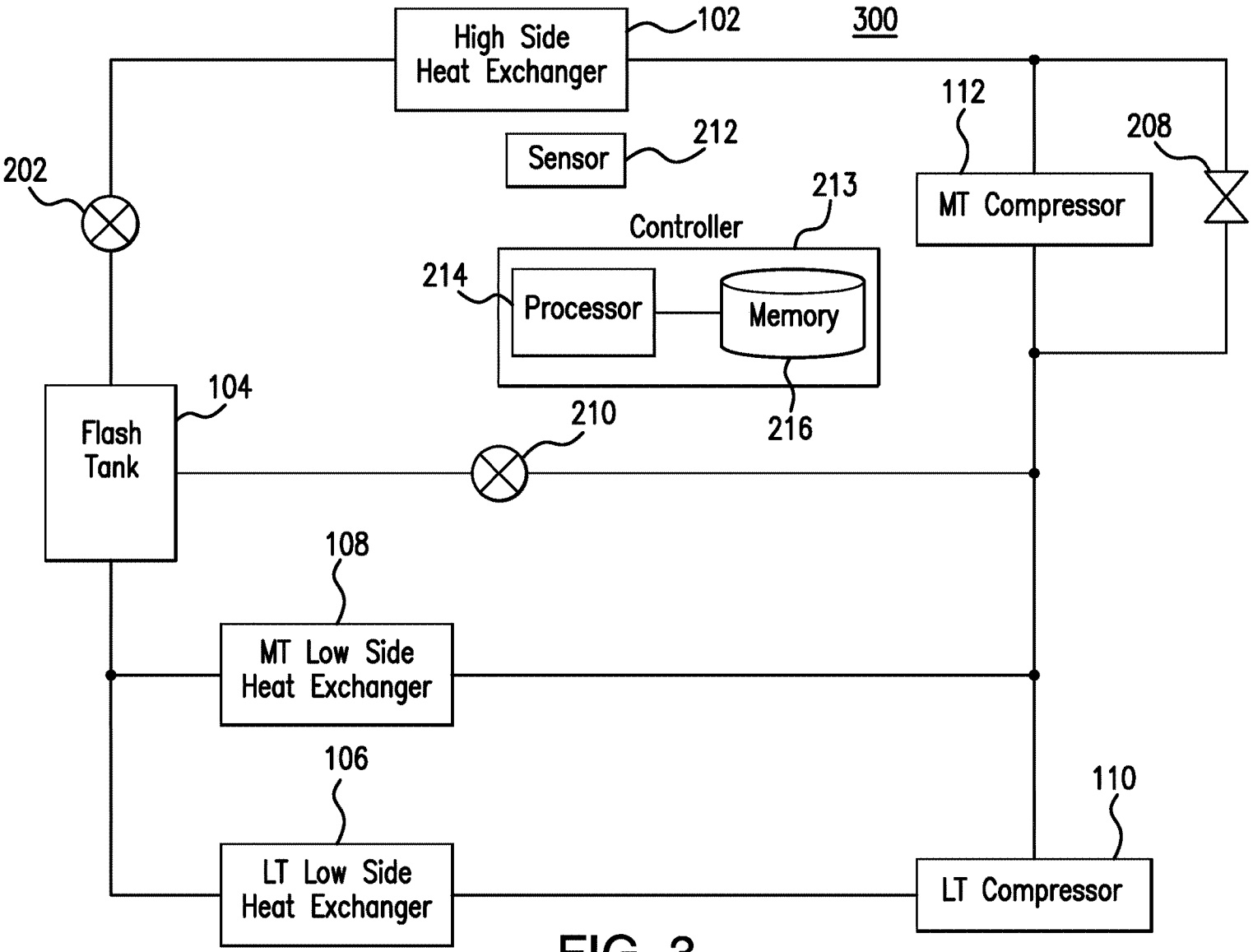
FIG. 3 illustrates an example cooling system.
Figure 4:
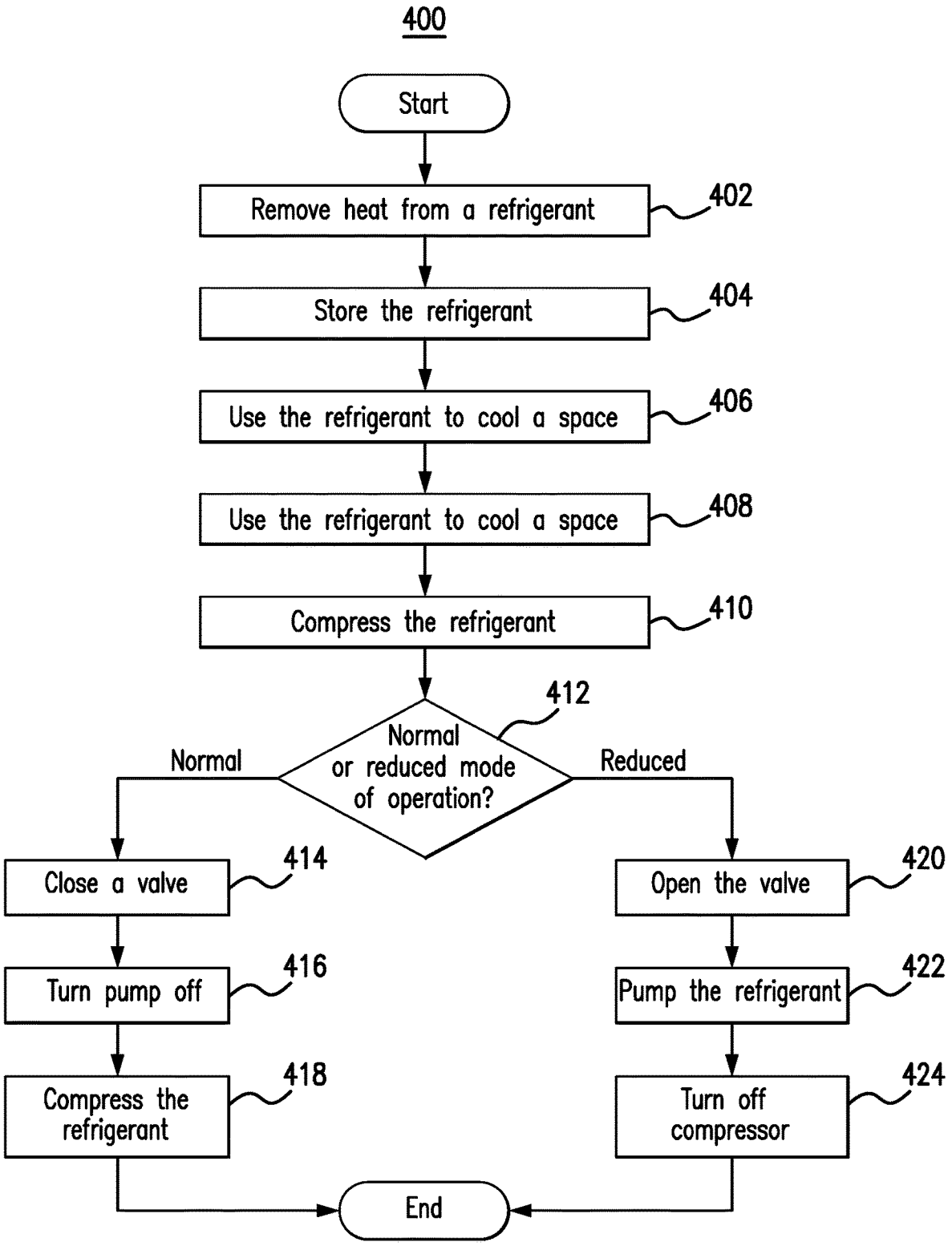
FIG. 4 is a flowchart illustrating a method of operating an example cooling system.

This disclosure contemplates an unconventional cooling system that generally bypasses one or more compressors when ambient temperatures are low. The system includes a bypass line and valve that opens when ambient temperatures are low and/or when the pressure of the refrigerant in the system is low. In this manner, the refrigerant can flow through the bypass line instead of through one or more compressors. These compressors may then be shut off. To supply any needed pressure to cycle the refrigerant, the system may include a pump that turns on when the bypass line is open. When ambient temperatures are extremely low, thermosiphon may be used to cycle the refrigerant rather than a pump. The cooling system will be described using FIGS. 1 through 4. FIG. 1 will describe an existing cooling system. FIGS. 2 through 4 describe the cooling system that allows for compressor bypass.

FIG. 1 illustrates an example cooling system 100. As shown in FIG. 1, system 100 includes a high side heat exchanger 102, a flash tank 104, a low temperature low side heat exchanger 106, a medium temperature low side heat exchanger 108, a low temperature compressor 110, and a medium temperature compressor 112. Generally, system 100 cycles a refrigerant to cool spaces proximate the low side heat exchangers 106 and 108. Cooling system 100 or any cooling system described herein may include any number of low side heat exchangers, whether low temperature or medium temperature.

High side heat exchanger 102 removes heat from a refrigerant. When heat is removed from the refrigerant, the refrigerant is cooled. High side heat exchanger 102 may be operated as a condenser and/or a gas cooler. When operating as a condenser, high side heat exchanger 102 cools the refrigerant such that the state of the refrigerant changes from a gas to a liquid. When operating as a gas cooler, high side heat exchanger 102 cools gaseous refrigerant and the refrigerant remains a gas. In certain configurations, high side heat exchanger 102 is positioned such that heat removed from the refrigerant may be discharged into the air. For example, high side heat exchanger 102 may be positioned on a rooftop so that heat removed from the refrigerant may be discharged into the air. As another example, high side heat exchanger 102 may be positioned external to a building and/or on the side of a building. This disclosure contemplates any suitable refrigerant (e.g., carbon dioxide) being used in any of the disclosed cooling systems.

Flash tank 104 stores refrigerant received from high side heat exchanger 102. This disclosure contemplates flash tank 104 storing refrigerant in any state such as, for example, a liquid state and/or a gaseous state. Refrigerant leaving flash tank 104 is fed to low temperature low side heat exchanger 106 and medium temperature low side heat exchanger 108. In some embodiments, a flash gas and/or a gaseous refrigerant is released from flash tank 104. By releasing flash gas, the pressure within flash tank 104 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 104 to both the low temperature and medium temperature portions of the refrigeration system. For example, the refrigerant flows to low temperature low side heat exchanger 106 and medium temperature low side heat exchanger 108.

When the refrigerant reaches low temperature low side heat exchanger 106 or medium temperature low side heat exchanger 108, the refrigerant removes heat from the air around low temperature low side heat exchanger 106 or medium temperature low side heat exchanger 108. For example, the refrigerant cools metallic components (e.g., metallic coils, plates, and/or tubes) of low temperature low side heat exchanger 106 and medium temperature low side heat exchanger 108 as the refrigerant passes through low temperature low side heat exchanger 106 and medium temperature low side heat exchanger 108. These metallic components may then cool the air around them. The cooled air may then be circulated such as, for example, by a fan to cool a space such as, for example, a freezer and/or a refrigerated shelf. As refrigerant passes through low temperature low side heat exchanger 106 and medium temperature low side heat exchanger 108, the refrigerant may change from a liquid state to a gaseous state as it absorbs heat. Any number of low temperature low side heat exchangers 106 and medium temperature low side heat exchangers 108 may be included in any of the disclosed cooling systems.

Refrigerant flows from low temperature low side heat exchanger 106 and medium temperature low side heat exchanger 108 to compressors 110 and 112. The disclosed cooling systems may include any number of low temperature compressors 110 and medium temperature compressors 112. Both the low temperature compressor 110 and medium temperature compressor 112 compress refrigerant to increase the pressure of the refrigerant. As a result, the heat in the refrigerant may become concentrated and the refrigerant may become a high-pressure gas. Low temperature compressor 110 compresses refrigerant from low temperature low side heat exchanger 106 and sends the compressed refrigerant to medium temperature compressor 112. Medium temperature compressor 112 compresses a mixture of the refrigerant from low temperature compressor 110 and medium temperature low side heat exchanger 108. Medium temperature compressor 112 then sends the compressed refrigerant to high side heat exchanger 102.

When ambient temperatures (e.g., outdoor temperatures, temperatures around high side heat exchanger 102, and temperatures around compressors 110 and 112 and/or flash tank 104) are too cold, the pressure of the refrigerant in the system may drop too low for the compressors 110 and/or 112 to operate effectively. To remedy this drop in pressure, conventional systems may reduce the speed of or turn off high side heat exchanger 102. In instances where not much cooling is needed (e.g., because ambient temperatures are low), the compressors 110 and/or 112 may also cycle on and off frequently, wasting energy.

This disclosure contemplates an unconventional cooling system that generally bypasses one or more compressors when ambient temperatures are low. The system includes a bypass line and valve that opens when ambient temperatures are low and/or when the pressure of the refrigerant in the system is low. In this manner, the refrigerant can flow through the bypass line instead of through one or more compressors. These compressors may then be shut off. To supply any needed pressure to cycle the refrigerant, the system may include a pump that turns on when the bypass line is open. When ambient temperatures are extremely low, thermosiphon may be used to cycle the refrigerant rather than a pump. Embodiments of the cooling system are described below using FIGS. 2-4. These figures illustrate embodiments that include a certain number of low side heat exchangers and compressors for clarity and readability. These embodiments may include any suitable number of low side heat exchangers and compressors.

FIG. 2 illustrates an example cooling system 200. As seen in FIG. 2, system 200 includes a high side heat exchanger 102, a flash tank, 104, a low temperature low side heat exchanger 106, a medium temperature low side heat exchanger 108, a low temperature compressor 110, a medium temperature compressor 112, a valve 202, a valve 204, a pump 206, a valve 208, a valve 210, a sensor 212, and a controller 213. Generally, system 200 allows for medium temperature compressor 112 to be bypassed and/or shut off when ambient temperatures are too cold. Pump 206 may be used to supply pressure to circulate refrigerant in system 200 when medium temperature compressor 112 is shut off. In this manner, system 200 may avoid wasting energy resulting from operating medium temperature compressor 112 when ambient temperatures are too cold in certain embodiments.

High side heat exchanger 102, flash tank 104, low temperature low side heat exchanger 106, medium temperature low side heat exchanger 108, and low temperature compressor 110 operate similarly in system 200 as they did in system 100. For example, high side heat exchanger 102 removes heat from a refrigerant. Flash tank 104 stores the refrigerant. Low temperature low side heat exchanger 106 and medium temperature low side heat exchanger 108 use the refrigerant from flash tank 104 to cool spaces proximate low temperature low side heat exchanger 106 and medium temperature heat exchanger 108. Low temperature compressor 110 compresses the refrigerant from low temperature low side heat exchanger 106.

Valve 202 controls the flow of refrigerant from high side heat exchanger 102 to flash tank 104. When valve 202 is closed, refrigerant is prevented from flowing from high side heat exchanger 102 to flash tank 104. When valve 202 is opened, refrigerant flows from high side heat exchanger 102 to flash tank 104. In certain embodiments, valve 202 is an expansion valve that further reduces the pressure of refrigerant that flows through valve 202 before reaching flash tank 104.

Valve 204 controls a flow of refrigerant from flash tank 104 to low side heat exchanger 106 and medium temperature low side heat exchanger 108. When valve 204 is opened, refrigerant flows from flash tank 104 to low side heat exchanger 106 and medium temperature low side heat exchanger 108 through valve 204. When valve 204 is closed, refrigerant stops flowing from flash tank 104 to low temperature low side heat exchanger 106 and medium temperature low side heat exchanger 108 through valve 204. In certain embodiments, valve 204 is a solenoid valve or a ball valve that can be opened or closed using a control. For example, controller 213 may cause valve 204 to open and close by sending signals to a component of valve 204 (e.g., a switch or motor).

Pump 206 may pump and/or move refrigerant from flash tank 104 to low temperature low side heat exchanger 106 and medium temperature low side heat exchanger 108 when pump 206 is turned on. When pump 206 is turned off, refrigerant does not flow from flash tank 104 to low temperature low side heat exchanger 106 and medium temperature low side heat exchanger 108 through pump 206. Pump 206 moves refrigerant by increasing the pressure of that refrigerant such that the refrigerant moves in a direction from flash tank 104 to low temperature low side heat exchanger 106 and medium temperature low side heat exchanger 108.

In certain embodiments, valve 204 and pump 206 provide alternative channels through which refrigerant from flash tank 104 can flow to low temperature low side heat exchanger 106 and medium temperature low side exchanger 108. For example, when ambient temperatures are too cold, valve 204 may be closed and pump 206 may be used to push refrigerant from flash tank 104 to low temperature low side heat exchanger 106 and medium temperature low side heat exchanger 108. When ambient temperatures are not too cold, valve 204 may be opened and pump 206 may be turned off. Refrigerant may flow from flash tank 104 to low temperature low side heat exchanger 106 and medium temperature low side heat exchanger 108 through valve 204.

Valve 208 allows refrigerant to bypass medium temperature compressor 112. When valve 208 is opened, refrigerant may bypass medium temperature compressor 112 by flowing through valve 208. When valve 208 is closed, refrigerant is directed through medium temperature compressor 112. In this manner, valve 208 provides an alternative channel through which refrigerant can flow to bypass medium temperature compressor 112, such as, for example, when medium temperature compressor 112 is turned off. In certain embodiments, when ambient temperatures are too cold, valve 208 may be opened and medium temperature compressor 112 may be shut off such that refrigerant flows through valve 208 to bypass medium temperature compressor 112. When ambient temperatures are normal, valve 208 may be closed and medium temperature compressor 112 may be turned on such that refrigerant is directed through medium temperature compressor 112 to be compressed.

Valve 210 controls a flow of flash gas from flash tank 104. When valve 210 is closed, flash tank 104 may not discharge flash gas through valve 210. When valve 210 is open, flash tank 104 may discharge flash gas through valve 210. In this manner, valve 210 may also control an internal pressure of flash tank 104. Valve 210 directs flash gas to medium temperature compressor 112 and/or valve 208. When flash gas is directed to medium temperature compressor 112, medium temperature compressor 112 compresses the flash gas along with refrigerant from low temperature compressor 110 and medium temperature low side heat exchanger 108. When flash gas is directed to valve 208, flash gas flows through valve 208 to high side heat exchanger 102.

Sensor 212 detects one or more characteristics of system 200. In certain embodiments, sensor 212 is a temperature sensor that detects ambient temperatures around system 200. For example, sensor 212 may detect an outdoor temperature, a temperature around high side heat exchanger 102, a temperature around flash tank 104, a temperature around low temperature low side heat exchanger 106, a temperature around medium temperature low side heat exchanger 108, a temperature around low temperature compressor 110, and/or a temperature around medium temperature compressor 112. The detected temperature may be used to determine whether system 200 should transition between modes of operation. In some embodiments, sensor 212 is a pressure sensor that detects a pressure of refrigerant cycling in system 200. The detected pressure may be used to determine whether system 200 should transition between modes of operation.

Controller 213 includes a processor 214 and a memory 216. Processor 214 and memory 216 may be configured to perform any of the functions of controller 213 described herein. Generally, controller 213 determines when system 200 should transition between modes of operation. Controller 213 also causes certain components of system 200 to change states to transition between modes of operation.

Processor 214 is any electronic circuitry, including, but not limited to microprocessors, application specific integrated circuits (ASIC), application specific instruction set processor (ASIP), and/or state machines, that communicatively couples to memory 216 and controls the operation of controller 213 and/or system 200. Processor 214 may be 8-bit, 16-bit, 32-bit, 64-bit or of any other suitable architecture. Processor 214 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 214 may include other hardware that operates software to control and process information. Processor 214 executes software stored on memory to perform any of the functions described herein. Processor 214 controls the operation and administration of controller 213 and/or system 200 by processing information received from components of system 200 (e.g., sensor 212 and memory 216). Processor 214 may be a programmable logic device, a microcontroller, a microprocessor, any suitable processing device, or any suitable combination of the preceding. Processor 214 is not limited to a single processing device and may encompass multiple processing devices.

Memory 216 may store, either permanently or temporarily, data, operational software, or other information for processor 214. Memory 216 may include any one or a combination of volatile or non-volatile local or remote devices suitable for storing information. For example, memory 216 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in memory 216, a disk, a CD, or a flash drive. In particular embodiments, the software may include an application executable by processor 214 to perform one or more of the functions described herein.

Controller 213 uses measurements from sensor 212 to determine whether system 200 should transition between modes of operation. For example, controller 213 may use temperature measurements from sensor 212 to determine whether ambient temperatures are too cold. As another example, controller 213 may receive pressure measurements from sensor 212 to determine whether the pressure of refrigerant in system 200 is too low. If controller 213 determines that ambient temperatures and/or refrigerant pressure are normal, then controller 213 may operate system 200 in a normal mode of operation. In the normal mode of operation, valves 204 and 208 are open, pump 206 is off, and medium temperature compressor 112 is on. High side heat exchanger 102 removes heat from a refrigerant and flash tank 104 stores the refrigerant. Low temperature low side heat exchanger 106 and medium temperature low side heat exchanger 108 use refrigerant from flash tank 104 to cool spaces proximate low side heat exchanger 106 and medium temperature low side heat exchanger 108. Low temperature compressor 110 compresses refrigerant from low temperature low side heat exchanger 106. Medium temperature compressor 112 compresses refrigerant from medium temperature low side heat exchanger 108 and low temperature compressor 110, and/or flash gas from flash tank 104.

When controller 213 determines that ambient temperatures and/or refrigerant pressure are low, controller 213 may cause system 200 to operate in a reduced mode of operation. Controller 213 may make this determination by comparing the detected ambient temperature and/or the detected refrigerant pressure to preset thresholds. If the determined ambient temperatures and/or detected refrigerant pressures fall below the preset thresholds, controller 213 may transition system 200 to operate in the reduced mode of operation. For example, if controller 213 determines that a detected ambient temperature is below zero degrees Fahrenheit, then controller 213 may transition system 200 to the reduced mode of operation. To transition to the reduced mode of operation, controller 213 may cause valve 204 to close, cause valve 208 to open, and shut off medium temperature compressor 112. In this manner, medium temperature compressor 112 no longer compresses refrigerant. Instead, refrigerant is directed to high side heat exchanger 102 through valve 208 to bypass medium temperature compressor 112. To supply pressure that was lost due to shutting off medium temperature compressor 112, controller 213 may turn on pump 206 to pump refrigerant from flash tank 104 to low temperature low side heat exchanger 106 and medium temperature low side heat exchanger 108. In this manner, medium temperature compressor 112 is shut off to save energy when ambient temperatures are too cold and/or when refrigerant pressure is too low.

In certain embodiments, to transition system 200 from the normal mode of operation to the reduced mode of operation, controller 213 further opens valve 202 and valve 210. Controller 213 may fully open valves 202 and 210 to reduce the pressure drop across valves 202 and valve 210 during the reduced mode of operation.

Controller 213 transitions system 200 from the reduced mode of operation to the normal mode of operation when a detected temperature and/or detected pressure are within normal bounds. For example, controller 213 may transition system 200 to the normal mode of operation when the detected ambient temperature is above a temperature threshold, such as, for example, zero degrees Fahrenheit. As another example, controller 213 may transition system 200 from the reduced mode of operation to the normal mode of operation when the temperature of the refrigerant in flash tank 104 is greater than the temperature of the refrigerant at medium temperature low side heat exchanger 108. To transition system 200 to the normal mode of operation, controller 213 may cause valve 204 to open, cause valve 208 to close, and turn on medium temperature compressor 112. In this manner, medium temperature compressor 112 compresses refrigerant from medium temperature low side heat exchanger 108, low temperature compressor 110, and/or flash gas from flash tank 104. In some embodiments, controller 213 may also cause valves 202 and 210 to partially close, such that they are not fully open.

FIG. 3 illustrates an example cooling system 300. As seen in FIG. 3, system 300 includes a high side heat exchanger 102, flash tank 104, low temperature low side heat exchanger 106, medium temperature low side heat exchanger 108, low temperature compressor 110, medium temperature compressor 112, valve 202, valve 208, valve 210, sensor 212, and controller 213. Generally, system 300 is suitable for installations where ambient temperatures are even colder than the ambient temperatures for system 200. When ambient temperatures are very cold, the temperature difference between refrigerant in flash tank 104 and the ambient temperature supplies the pressure to drive the refrigerant through system 300. This temperature difference effectively creates a thermosiphon that drives through system 300.

Generally, system 300 operates similarly as system 200. However, because system 300 uses the thermosiphon effect to drive refrigerant through system 300, pump 206 and valve 204 are removed from system 300. In certain embodiments, system 200 may be effectively the same as system 300 by turning off pump 206 and fully opening valve 204 to transition to a further reduced mode of operation, as described below.

System 300 can operate in a further reduced mode of operation due to the thermosiphon effect. In this further reduced mode of operation, valve 208 is open and medium temperature compressor 112 is shut off. As a result, during this further reduced mode of operation, refrigerant is pushed through system 300 by the thermosiphon effect. The refrigerant flows through valve 208 to bypass medium temperature compressor 112. In this manner, the further reduced mode of operation saves additional energy over the reduced mode of operation by not operating pump 206.

In certain embodiments, the temperature threshold for transitioning to the further reduced mode of operation is −20 degrees Fahrenheit. In other words, when controller 213 determines that the detected ambient temperature falls below −20 degrees Fahrenheit, controller 213 may transition system 200 and/or 300 to the further reduced mode of operation. Additionally, in some embodiments, controller 213 may transition system 200 and/or 300 to the further reduced mode of operation by fully opening valves 202 and 210 to reduce the pressure drop across valves 202 and 210.

As discussed above, controller 213 can also transition system 200 from the normal mode of operation or the reduced mode of operation to the further reduced mode of operation. To transition to the further reduced mode of operation, controller 213 may shut off pump 206, cause valves 204 and 208 to open, and shut off medium temperature compressor 112. Controller 213 may transition system 200 to the further reduced mode of operation when a detected ambient temperature is very cold (e.g., below −20 degrees Fahrenheit). In the further reduced mode of operation, further energy savings can be achieved over the reduced mode of operation by using the thermosiphon effect to push refrigerant through system 200 rather than using pump 206.

FIG. 4 is a flowchart illustrating a method 400 of operating an example cooling system. In certain embodiments, various components of systems 200 perform the steps of method 400. By performing method 400, energy savings may be achieved when ambient temperatures fall below certain thresholds.

High side heat exchanger 102 removes heat from a refrigerant in step 402. Flash tank 104 stores the refrigerant in step 404. In step 406, low temperature low side heat exchanger 106 uses the refrigerant to cool a space. In step 408, medium temperature low side heat exchanger 108 uses the refrigerant to cool a space. Low temperature compressor 110 compresses the refrigerant in step 410.

In step 412, controller 213 determines whether system 200 should be operating in a normal or reduced mode of operation. Controller 213 may make this determination by comparing detected ambient temperatures and/or detected refrigerant pressures with preset thresholds. For example, if a detected ambient temperature falls below a preset threshold, controller 213 may determine that system 200 should operate in a reduced mode of operation. If a detected ambient temperature exceeds a preset threshold, then controller 213 may determine that system 200 should operate in a normal mode of operation.

If controller 213 determines that system 200 should operate in a normal mode of operation, controller 213 may cause valve 208 to close in step 414. Controller 213 may then cause pump 206 to turn off in step 416. Medium temperature compressor 112 may then be activated by controller 213 to compress the refrigerant in step 418.

If controller 213 determines that system 200 should be operating in a reduced mode of operation, controller 213 may cause valve 208 to open in step 420. Controller 213 may cause pump 206 to turn on in step 422 to pump the refrigerant. Controller 213 may turn off medium temperature compressor 112 in step 424. Although described as discrete steps with a particular ordering, steps 414, 416, and 418 may be performed together or in any order. Additionally, steps 420, 422, and 424 may be performed together or in any order.

Modifications, additions, or omissions may be made to method 400 depicted in FIG. 4. Method 400 may include more, fewer, or other steps. For example, steps may be performed in parallel or in any suitable order. While discussed as particular components of system 200 performing the steps, any suitable component of systems 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the high side heat exchanger) even though there may be other intervening components between the particular component and the destination of the refrigerant. For example, the flash tank receives a refrigerant from the high side heat exchanger even though there is a valve between the flash tank and the high side heat exchanger.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. A system comprising:

a flash tank configured to store refrigerant;

a first low side heat exchanger configured to use refrigerant from the flash tank to cool a first space;

a second low side heat exchanger configured to use refrigerant from the flash tank to cool a second space;

a first compressor configured to compress refrigerant from the first low side heat exchanger;

a second compressor;

a first valve configured to control a flow of refrigerant to the second compressor;

a pump; and a second valve configured to control a flow of a flash gas from the flash tank;

during a first mode of operation:

the first valve is closed such that refrigerant is directed to the second compressor;

and the second compressor compresses refrigerant from the second low side heat exchanger and refrigerant from the first compressor;

during a second mode of operation:

the first valve is open such that refrigerant bypasses the second compressor;

the second valve is open such that the flash gas is directed to the first valve; and the pump pumps refrigerant from the flash tank to the first and second low side heat exchangers.

2. The system of claim 1, wherein the system:

transitions from the first mode of operation to the second mode of operation when a detected temperature falls below a first threshold; and transitions from the second mode of operation to the first mode of operation when a detected temperature exceeds the first threshold.

3. The system of claim 2, wherein during a third mode of operation:

the first valve is open such that refrigerant bypasses the second compressor;

the pump is off; and the second compressor is off.

4. The system of claim 3, wherein the system transitions from the second mode of operation to the third mode of operation when a detected temperature falls below a second threshold lower than the first threshold.

5. The system of claim 1, further comprising a third valve configured to control a flow of refrigerant from the flash tank to the first and second low side heat exchangers, the third valve configured to close during the second mode of operation such that refrigerant from the flash tank is directed to the pump.

6. The system of claim 1, further comprising a third valve configured to control a flow of refrigerant to the flash tank, wherein the third valve is open during the second mode of operation.

7. A method comprising:

storing, by a flash tank, a refrigerant;

using, by a first low side heat exchanger, refrigerant from the flash tank to cool a first space;

using, by a second low side heat exchanger, refrigerant from the flash tank to cool a second space;

compressing, by a first compressor, refrigerant from the first low side heat exchanger;

controlling, by a second valve, a flow of refrigerant, as a flash gas, from the flash tank;

during a first mode of operation, compressing, by a second compressor, refrigerant from the second low side heat exchanger and refrigerant from the first compressor while a first valve is closed such that refrigerant is directed to the second compressor; and during a second mode of operation:

pumping, by a pump, refrigerant from the flash tank to the first and second low side heat exchangers while the first valve is open such that refrigerant bypasses the second compressor;

actuating a second valve to open, wherein the second valve is configured to control a flow of a flash gas from the flash tank; and directing the flow of the flash gas from the flash tank to the first valve.

8. The method of claim 7, further comprising:

transitioning from the first mode of operation to the second mode of operation when a detected temperature falls below a first threshold; and transitioning from the second mode of operation to the first mode of operation when a detected temperature exceeds the first threshold.

9. The method of claim 8, wherein during a third mode of operation:

the first valve is open such that refrigerant bypasses the second compressor;

the pump is off; and the second compressor is off.

10. The method of claim 9, further comprising transitioning from the second mode of operation to the third mode of operation when a detected temperature falls below a second threshold lower than the first threshold.

11. The method of claim 7, further comprising:

controlling, by a second valve, a flow of refrigerant from the flash tank to the first and second low side heat exchangers; and closing the second valve during the second mode of operation such that refrigerant from the flash tank is directed to the pump.

12. The method of claim 7, further comprising:

controlling, by a third valve configured to control a flow of refrigerant to the flash tank; and opening the third valve during the second mode of operation.

13. A system comprising:

a flash tank configured to store refrigerant;

a first low side heat exchanger configured to use refrigerant from the flash tank to cool a first space;

a second low side heat exchanger configured to use refrigerant from the flash tank to cool a second space;

a first compressor configured to compress refrigerant from the first low side heat exchanger;

a second compressor;

a first valve; and a second valve configured to control a flow of a flash gas from the flash tank;

during a first mode of operation:

the first valve is closed such that refrigerant is directed to the second compressor; and the second compressor compresses refrigerant from the second low side heat exchanger and refrigerant from the first compressor;

during a second mode of operation:

the first valve is open such that refrigerant bypasses the second compressor; and the second valve is open such that the flash gas is directed to the first valve.

14. The system of claim 13, wherein the system:

transitions from the first mode of operation to the second mode of operation when a detected temperature falls below a threshold; and transitions from the second mode of operation to the first mode of operation when a detected temperature exceeds the threshold.

15. The system of claim 14, wherein the threshold is −20 degrees Fahrenheit.

16. The system of claim 14, further comprising a high side heat exchanger configured to remove heat from the refrigerant, wherein during the second mode of operation, refrigerant from the flash tank flows through the first and second low side heat exchangers to the high side heat exchanger by thermosiphon, and a difference between a temperature of refrigerant in the flash tank and the detected temperature causes the thermosiphon.

17. The system of claim 16, further comprising a third valve configured to control a flow of refrigerant from the high side heat exchanger to the flash tank, wherein the second valve is open during the second mode of operation.

* * * * *